United States Patent [19]

Thrower

[11] 4,421,257

[45] Dec. 20, 1983

[54] METAL POURING NOZZLE WITH GAS INLET

[75] Inventor: Anthony Thrower, Woodhouse, near Sheffield, England

[73] Assignee: USS Engineers and Consultants, Inc., Pittsburgh, Pa.

[21] Appl. No.: 344,092

[22] Filed: Jan. 29, 1982

[30] Foreign Application Priority Data

Feb. 12, 1981 [GB] United Kingdom ..... 8104359

[51] Int. Cl.[3] ..... B22D 41/08

[52] U.S. Cl. ..... 222/600; 222/603; 266/265; 266/271

[58] Field of Search ..... 222/600, 603, 606, 607; 266/218, 220, 265, 271, 272; 164/66.1, 259, 415, 475

[56] References Cited

U.S. PATENT DOCUMENTS 3,253,307 5/1966 Griffiths et al. ..... 222/603 X 3,337,329 8/1967 Finkl ..... 222/590 X

FOREIGN PATENT DOCUMENTS 2732340 2/1979 Fed. Rep. of Germany ..... 222/603

*Primary Examiner*—David A. Scherbel

*Attorney, Agent, or Firm*—John F. Carney

[57] ABSTRACT

A metal pouring ladle furnished with a sliding gate valve has a bottom pour opening fitted with a well block and a nozzle seated in the lower portion thereof, the well block and nozzle forming a flow passage leading to the valve. For introducing gas to the melt, a pipe is cast in the well block, the pipe opening to the bore of the well block above the nozzle or into an annular space encircling the top end of the nozzle component. This permits gassing before teeming commences without recourse to the flow passage through the nozzle, and so gassing is possible without disturbing any particulate silicious filler which may have been placed in the nozzle passage.

6 Claims, 2 Drawing Figures

METAL POURING NOZZLE WITH GAS INLET

BACKGROUND OF THE INVENTION

The present invention relates to a metal pouring apparatus and method.

When a bottom pour vessel such as a ladle is prepared for teeming, it is common to inject gas into its molten contents in the vicinity of the vessel well area which leads to the bottom pour opening of the vessel. Gassing is performed for several purposes including rinsing; clearing the relatively-cool well area of solidification products; lowering and/or equalising the temperature throughout the melt and redistributing chilled melt adjacent the sides and bottom of the vessel; and stirring to distribute alloying additions uniformly in the melt. Gas injection is also frequently used for introducing particulate matter to the melt for dissolution, the gas being a carrier therefor.

Gassing has hitherto been accomplished in several ways, each having disadvantages. Lancing involves lowering a refractory-coated pipe or lance into the melt. The lance is a costly item and has but limited life, for it is subject to deleterious attack or burn-through in the region of the slag layer floating on the melt. In another approach, the vessel lining is provided with an opening in which a porous plug is seated. The plug has a gas-supply pipe depending therefrom which passes through an aperture in the exterior of the vessel. The gas supply is then connected beneath the vessel to the pipe. Leakage of melt between plug and lining can occur especially if either is damaged or eroded, and hence use of such a plug for gassing has potentially grave hazards.

Where teeming from bottom pour vessels is controlled by sliding gate valves, it is inconvenient to employ a well plug as just outlined. Gassing may then be accomplished through the valve which has a special valve closure element furnished with a porous plug, the plug being gas permeable but impenetrable by the melt. See U.S. patent specification No. 3,581,948 assigned to Interstop A.G. It is not always convenient nor cost effective to use such special closure elements. Alternatively, the well or part thereof may be formed by a gas-porous brick, through which gas is pumped to the teeming passage. See. G.B. patent specification 1,351,618 to Didier Werke A.G.

Steelmakers often wish to fill the bottom pour opening with a silicious filler (sand or a mixture of sand and graphite) before the melt is introduced to the vessel. This is inter alia to prevent freezing in the opening and ensure teeming commences cleanly when the sliding gate valve is opened for the first time. With gassing arrangements as disclosed in the aforementioned patents a significant risk may arise that the gas will upset the silicious filling. One of our aims has been to devise means for gassing which is capable of avoiding this risk.

In practice, of course, teeming from a vessel is not always a one-shot operation. Commonly teeming is interrupted, as where several moulds are to be filled. The silicious filling is lost upon start of the first teem, but gassing may still be desired during later teems. The arrangement we have devised can be used in this way and no special valve closure elements are required.

SUMMARY OF THE INVENTION

According to the present invention, there is provided a bottom pour vessel for molten metal teeming via a sliding gate valve attached thereto, the vessel having a well block in a bottom pour opening of the vessel, the well block having a bore defining a flow passage and a lower part of the well block accommodating an internal nozzle for conveying to the valve melt in use flowing into the flow passage part of the well block, the vessel further having a gas conduit leading into and through the well block to a gas outlet opening located either in the wall of the bore defining the flow passage part of the well block above the nozzle, or in the said wall below but adjacent the location of an upper extremity of the nozzle, for gas to enter the well via the joint between the nozzle and the well block bore.

According to the present invention there is also provided a method of teeming molten metal from a vessel under the control of a sliding gate valve, wherein preparatory to opening the valve for teeming gas is injected into a well of the vessel, said well comprising a well block having a nozzle in a lower part thereof which opens to the valve, gas being injected into an upper part of the well block, without passage through the nozzle, by way of a gas outlet disposed in the well block inner wall upstream of the nozzle or in the upper portion of a juncture between the nozzle and the well block inner wall, and thereafter the valve is opened.

Further, the invention provides a method of teeming molten metal from a vessel under the control of a sliding gate valve, wherein the vessel has a well block accommodating a nozzle in a lower part thereof which opens to the valve, and the method comprising the steps of (1) before charging the vessel with molten metal filling the nozzle with particulate silicious material, (2) before opening the valve injecting gas into an upper part of the well block, without passage through the nozzle so as to avoid disturbing its silicious filling, the gas being injected by way of a gas outlet disposed in the well block inner wall upstream of the nozzle or in the upper portion of a juncture between the nozzle and the said wall, and (3) thereafter opening the valve.

If the gas outlet is located in the joint or juncture region between well block and nozzle, means such as an encasing metal jacket around the nozzle can be used to prevent downward gas flow between the nozzle and well block inner wall, and also to keep to a minimum gas flow through the nozzle body to its interior.

BRIEF DESCRIPTION OF THE DRAWINGS

The invention will now be described in more detail by way of example only with reference to the accompanying drawings, in which.

DESCRIPTION OF A PREFERRED EMBODIMENT OF THE INVENTION

Figure 1:
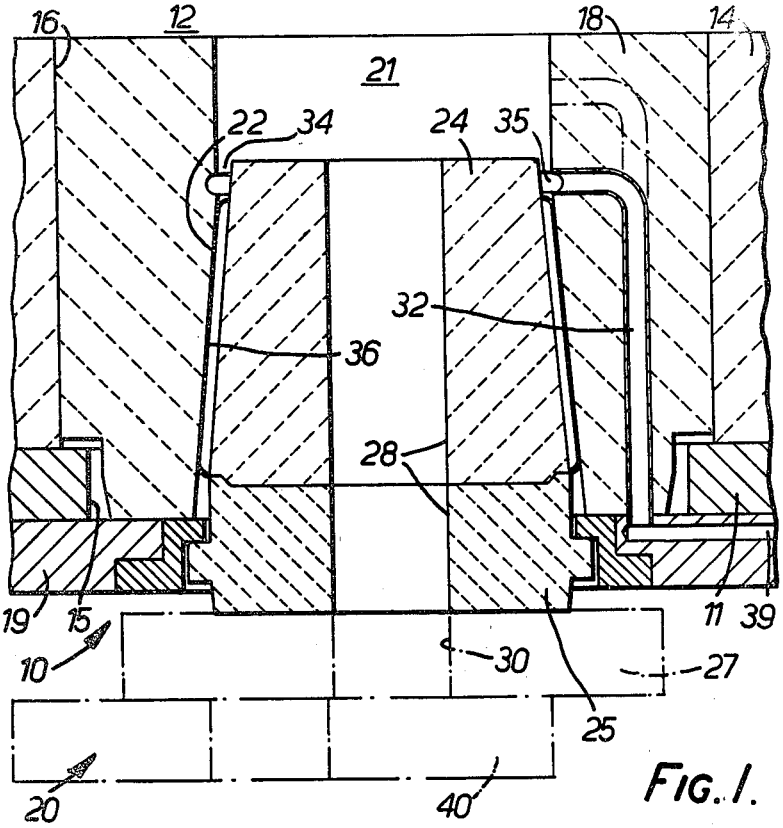
FIG. 1 is a fragmentary sectional view through a ladle according to the invention showing the well region thereof.
Figure 2:
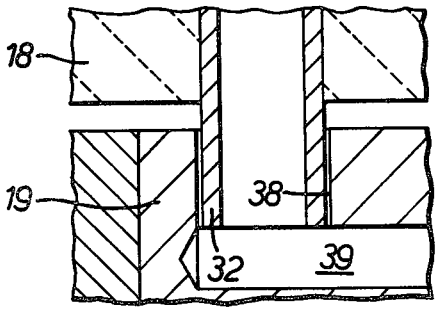
FIG. 2 is a portion of FIG. 1 on an enlarged scale.

In FIG. 1 of the drawings a ladle 10 has an iron or steel wall 11 insulated from the ladle interior 12 by a conventional lining 14. The wall 11 and lining 12 are apertured at 15, 16 to form a bottom pour opening and a wall block 18 is seated and cemented therein. The well block 18 has its lower end extending through the wall opening 15 and resting on a mounting plate 19 of a sliding gate valve 20. Plate 19 attaches the valve to the ladle 10, being fastened to the wall 11 by means not shown.

The well block 18 has a bore 21 therethrough. The bore has a parallel-sided wall in the upper part of the block and forms a flow passage for metal in use exiting the ladle. In a lower part of the block 18, the wall of the bore 21 is downwardly divergent. This divergent lower wall portion 22 forms a seating for a two-part nozzle 24, 25 replaceable, when necessary, from below. The nozzle is cemented in place in the well block. The main nozzle component is 24 and has a divergent radially outer wall conforming to the divergent wall portion 22. The lower nozzle component 25 extends outwardly from the vessel and sealingly contacts the orificed head plate 27 of the valve. Nozzle 24, 25 defines a passage 28 for leading molten metal from the flow passage to the valve 20. Head plate 27 has its orifice 30 coincident with the nozzle passage 28.

In the illustrated arrangement, the whole of the bore 21 in the upper well block part is parallel-sided; however in some cases there may be a flared mouth to the upper end of the bore.

Means is provided for introducing gas into the melt via the well area, in such a way that substantially no gas enters the well area from the nozzle passage 28. Gas is fed to the well area by a pipe 32 embedded in the well block 18, the pipe 32 opening to the bore 21 below but adjacent the upper extremity of nozzle component 24. At this location the component 24 is spaced slightly from the wall of the bore 21. Gas entering the annular space 34 from the outlet end of pipe 32 is injected into the well area in an upward direction from the region of the well block/nozzle joint. The space 34 forms a ring-shaped orifice and gas escaping therefrom may flow as a curtain upwardly along bore 21. Advantageously an encircling groove 35 coincident with the pipe outlet is formed in the wall of bore 21 to serve as a manifold.

Gas leaving the pipe 32 is prevented from flowing downwardly along the outer wall of the nozzle component 24 by an encasing metal jacket 36 and cement used to hold the nozzle in place. At its upper end the jacket 36 is located just below the pipe outlet and groove 34. All the refractory parts 14, 18, 24 and 25 are inevitably gas permeable to a limited extent. The metal jacket 36 encasing nozzle component 24 keeps gas flow therethrough to passage 28 to a minimum, and substantially all the gas entering the well area does so via the joint region or space 34.

If desired, the pipe could open to the wall of bore 21 at a location above the nozzle component 24. The pipe configuration in this case is shown chain dotted in FIG. 1. Again, a manifold groove equivalent to groove 35 can be provided.

The pipe 32 projects from the bottom end of the well block 18. The outward end of the pipe mates loosely with an aperture 38 in the mounting plate 19, the aperture being in communication with a gas passsage 39 in the plate 19. The passage 39 leads to a gas fitting, not shown, for connection to a suitable gas supply.

In operation, an inert gas will normally be fed to the well area, either alone or with alloying additions in a finely divided state. One suitable inert gas is argon. Other gases could be used including those which react with the melt, reaction being desirable if compositional or temperature changes are needed. Gas flow rates will depend on the particular function the gas is to perform, and suitable rates will be well within the ability of the addressee to select from experience. Since the gas issues upwardly from the joint space 34, it tends to flow as a curtain along the wall of bore 21 in the upper part of the well block. This can be advantageous, for the flow pattern will discourage solidification of metal or inclusions on the wall of the bore. Moreover, by arranging for the gas to enter the well area without having to pass along nozzle passage 28, the latter can be furnished with a silicious filler before the ladle receives its melt, and thereafter gassing can be carried out until teeming is commenced without disturbing the filler. Gassing can clearly be resumed subsequently if teeming has to be interrupted.

The outlet end of the pipe 32 might be attacked by molten metal during teeming, but this is not expected to prove troublesome. In the preferred embodiment the nozzle 24, 25, which as a practical matter has to be replaced frequently, will serve to shield the pipe 32 from the melt. Manufacture of the well block 18 by casting around the pipe 32 is straightforward and the structure is inexpensive.

Sliding gate valves are well established in the art, and hence valve 20 is only shown diagrammatically. The valve shown is a two plate valve comprising the stationary head plate 27 and a movable slide plate 40. The valve could be a three plate valve having stationary top and bottom plates with a movable slide plate therebetween. Such valves are known, of course.

The arrangement shown having the gas passage 39 in the mounting or adapter plate 19 for the valve is in many ways the most convenient. The passage 39 could be located elsewhere, e.g. in the ladle wall 11. Since conceivably the pipe 32 might become blocked, it may be advantageous to furnish the well block 18 with a plurality of pipes 32. Then, the pipes will communicate at their lower ends with a ring manifold receiving gas from passage 39 and formed in plate 19 or elsewhere.

I claim:

1. In combination, a molten metal teeming vessel having a bottom pour opening and a sliding gate valve containing relatively movable apertured plates attached to said vessel about said pour opening to control the flow of metal from said vessel, said vessel pour opening being defined by a wellblock positioned in the bottom of said vessel and having an axial bore therethrough, an internal nozzle having an axial flow opening for communication with the apertures of said sliding gate valve plates, said flow opening being of less diameter than that of said wellblock bore, said internal nozzle being disposed in the lower portion of said wellblock bore and having its upper end surface open to and axially spaced from the upper end of said wellblock bore, and means for injecting gas into said wellblock bore comprising:

(a) an annular space between the upper portion of said internal nozzle and the wall of said wellblock bore, (b) a gas supply conduit leading into and through said wellblock and having its discharge end opening into said annular space below but adjacent the upper end of said internal nozzle; and (c) means between the wall of said internal nozzle and the wall of said wellblock bore to prevent the flow of gas downwardly from said annular space.

2. The combination according to claim 1 in which said gas flow-preventing means includes a metal jacket encasing all but said upper portion of the radially outer surface of said internal nozzle.

3. The combination according to claims 1 or 2 in which the wall of said wellblock bore within said annular space contains an encircling groove coincident with the discharge end of said gas supply conduit to form a gas manifold.

4. The combination according to claim 3 in which said wellblock extends through a wall of said vessel, a mounting plate for attaching said valve to said vessel, a gas passage in said mounting plate and said gas supply conduit mating with said gas passage.

5. The combination according to claim 4 in which said mounting plate contains an aperture communicating with said gas passage and said gas supply conduit is a pipe having its trailing end protruding from said wellblock and disposed in said mounting plate aperture.

6. The combination according to claim 5 in which one of the apertured plates of said sliding gate valve is fixed with respect to said vessel pour opening and said internal nozzle is disposed in two vertically arranged parts, the lower of which parts sealingly contact said valve fixed plate.

* * * * *